US007625167B2

(12) United States Patent
Walchester

(10) Patent No.: US 7,625,167 B2
(45) Date of Patent: Dec. 1, 2009

(54) DUAL PATTERN CONTROL

(75) Inventor: Alan Leigh Walchester, Staffordshire (GB)

(73) Assignee: JCB Compact Products Limited, Rocester, Uttoxeter (GB)

( * ) Notice: Subject to any disclaimer, the term of this patent is extended or adjusted under 35 U.S.C. 154(b) by 82 days.

(21) Appl. No.: 11/675,694

(22) Filed: Feb. 16, 2007

(65) Prior Publication Data

US 2008/0047383 A1 Feb. 28, 2008

(30) Foreign Application Priority Data

Feb. 17, 2006 (GB) ..... 0603217.1

(51) Int. Cl.
*G05G 9/02* (2006.01)

(52) U.S. Cl. ..... 414/694; 74/471 XY; 137/636; 414/680

(58) Field of Classification Search ..... 414/680, 414/685, 694; 137/636, 636.2; 74/471 XY
See application file for complete search history.

(56) References Cited

U.S. PATENT DOCUMENTS 4,398,861 A 8/1983 Shimoie
4,736,647 A * 4/1988 Shimoie et al. ..... 74/471 XY

FOREIGN PATENT DOCUMENTS

| | | |
|---|---|---|
| GB | 2159492 | 12/1985 |
| GB | 2183795 | 6/1987 |
| GB | 2224337 | 2/1990 |
| GB | 2367347 A | 4/2002 |
| JP | 61072137 A | 4/1986 |
| JP | 03043522 A | 2/1991 |
| JP | 03125729 A | 5/1991 |
| JP | 03206216 A | 9/1991 |
| JP | 04034133 A | 2/1992 |
| JP | 06081371 A | 3/1994 |
| WO | WO92/09756 A1 | 11/1992 |

* cited by examiner

*Primary Examiner*—Donald Underwood
(74) *Attorney, Agent, or Firm*—MacMillan, Sobanski & Todd, LLC

(57) ABSTRACT

A control apparatus for material handling vehicle, the control apparatus having an operator control moveable in a first direction. A first actuator controls a first part of the material handling vehicle and a second actuator controls a second part of material handling vehicle. The control apparatus includes a mechanical link moveable between a first position to connect the operator control to the first actuator and a second position to connect the operator control to the second actuator such that movement of the operator control in the first direction causes selective operation of the first actuator or the second actuator.

9 Claims, 6 Drawing Sheets

DUAL PATTERN CONTROL

CROSS-REFERENCE TO RELATED APPLICATIONS

Priority is claimed to United Kingdom patent application Serial No. 0603217.1 filed Feb. 17, 2006.

STATEMENT REGARDING FEDERALLY SPONSORED RESEARCH OR DEVELOPMENT

Not Applicable.

TECHNICAL FIELD

This invention relates to a control apparatus for material handling vehicles.

BACKGROUND OF THE INVENTION

It is conventional for material handling vehicles to be provided with a number of operator controls to control a material handling implement mounted on the machine and, where the machine is rotatable to control the slewing movement of the material handling vehicle. For example, where the vehicle comprises a rotating machine having a two-part boom and a bucket, it is known for the operator to have one joystick which controls slewing movement of the vehicle and operation of the boom by movement of a left hand joystick along orthogonal axes, and controls movement of the bucket and dipper using a right hand joystick, again by movement of the joystick along orthogonal axes. This particular arrangement is called the ISO configuration. It is also known for there to be alternative control configurations. For example, in the SAE configuration, the left hand joy stick controls the slewing movement of the vehicle and the right hand joystick controls operation of the bucket of the material handling vehicle apparatus, but the operation of the left hand joystick also controls operation of the dipper and the right hand joystick operation of the boom, in the reverse arrangement to the ISO configuration. The provision of these two different control configurations can cause difficulties in that it requires two different types of controls to be provided in a material handling vehicle depending on the market for which that the vehicle is intended, and can also lead to potential safety hazards when a operator used to one configuration encounters a machine with a different configuration.

It is known to provide adaptable controls which used, for example, electronic systems to detect movement of the joysticks and control hydraulic systems accordingly, but such systems can be complex and represent and additional cost on a material handling vehicle.

The aim of the present invention is to reduce or provide a new or improved control apparatus for a material handling vehicle.

BRIEF SUMMARY OF THE INVENTION

The invention related to a control apparatus for material handling vehicle. The control apparatus having an operator control moveable in a first direction. A first actuator to control a first part of the material handling vehicle and a second actuator to operate a second part of material handling vehicle. The control apparatus includes a mechanical link moveable between a first position to connect the controller to the first actuator and a second position to connect the operator control to the second actuator such that movement of the operator control in the first direction causes operation of the first actuator or the second actuator. When the mechanical link in the first position, the second operator control may be connected to control to the second actuator and in the second position the second operator control may be connected to the first actuator.

Various objects and advantages of the invention will become apparent from the following detailed description of the invention and the accompanying drawings.

DETAILED DESCRIPTION OF THE INVENTION

Figure 1:
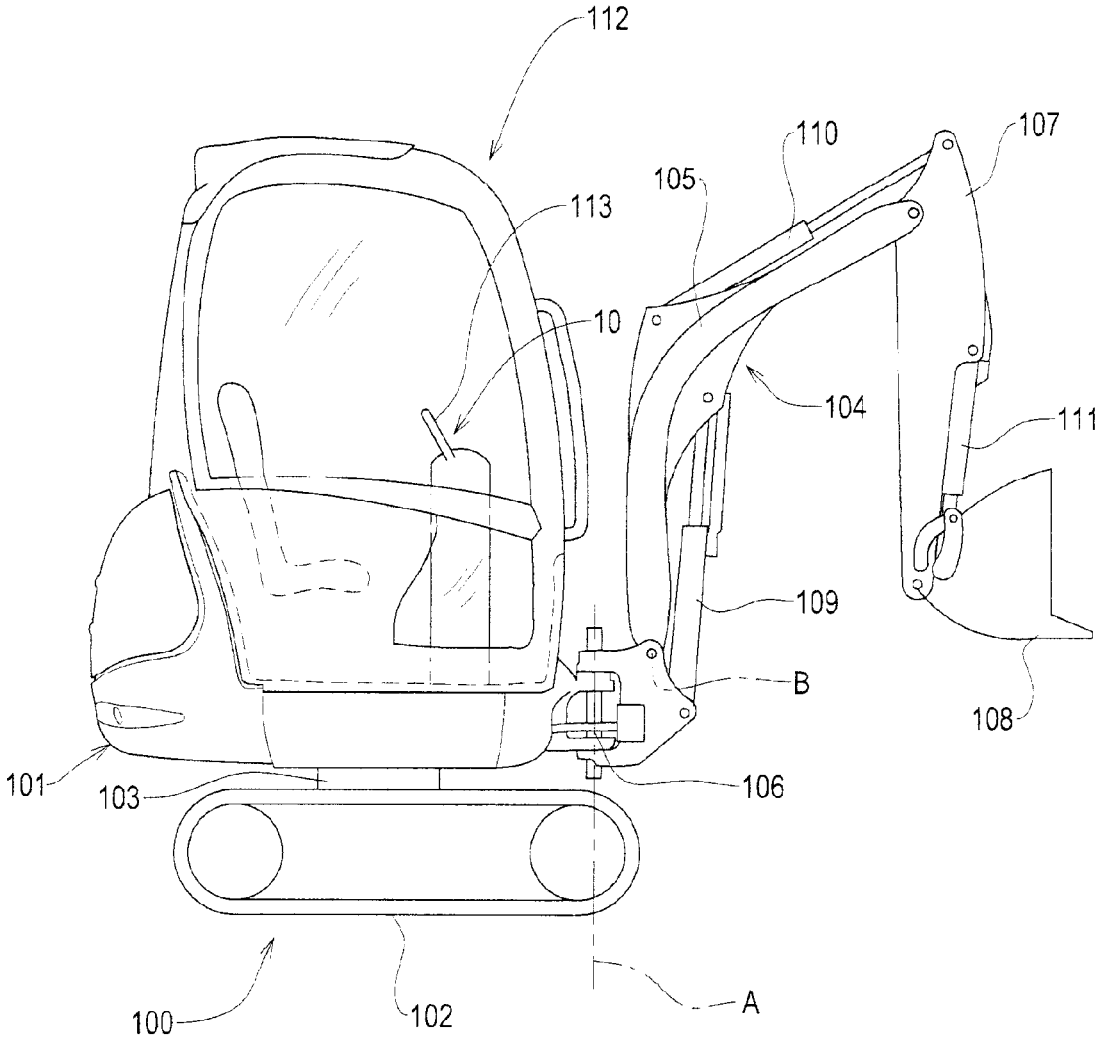
FIG. 1 is a side view of a material handling vehicle having a vehicle control apparatus embodying the present invention.

Referring now to FIG. 1, an example of a material handling vehicle is shown generally at 100. The vehicle 100 has a body 101 rotatably mounted on chassis 102 by a suitably rotating joint 103. The vehicle is provided with a material handling apparatus shown at 104 comprising a boom 105 pivotally mounted to the body 101 by king post assembly 106 such that the boom 104 is rotatable about a vertical axis A and a horizontal axis B. The boom 105 further has a dipper arm 107 pivotally connected thereto, and a material handling implement, in the present example comprising a bucket, shown at 108 pivotally mounted on the dipper arm 107. The material handling apparatus 104 has a first hydraulic ram 109 connected between the king post assembly 106 and the boom 105 to cause pivotal motion about axis B, a hydraulic ram 110 connected between the boom 105 and the dipper arm 107 to cause pivoting movement of the dipper arm 107 in a vertical plane, and a hydraulic ram 111 connected between the dipper arm 107 and the material handling implement 108 to permit crowding and a tipping movement of the implement 108. A suitable hydraulic control (not shown) is also provided to provide pivotal movement of the king post assembly and hence the material handling apparatus 104 about vertical axis A.

The body 101 is provided with an operator's cab 112 having operator controls generally shown at 113 to provide full control of the various hydraulic rams and other operating systems of the vehicle 100. The operator controls 113 include a control apparatus generally shown at 10 which will be described in more detail below.

Figure 2:
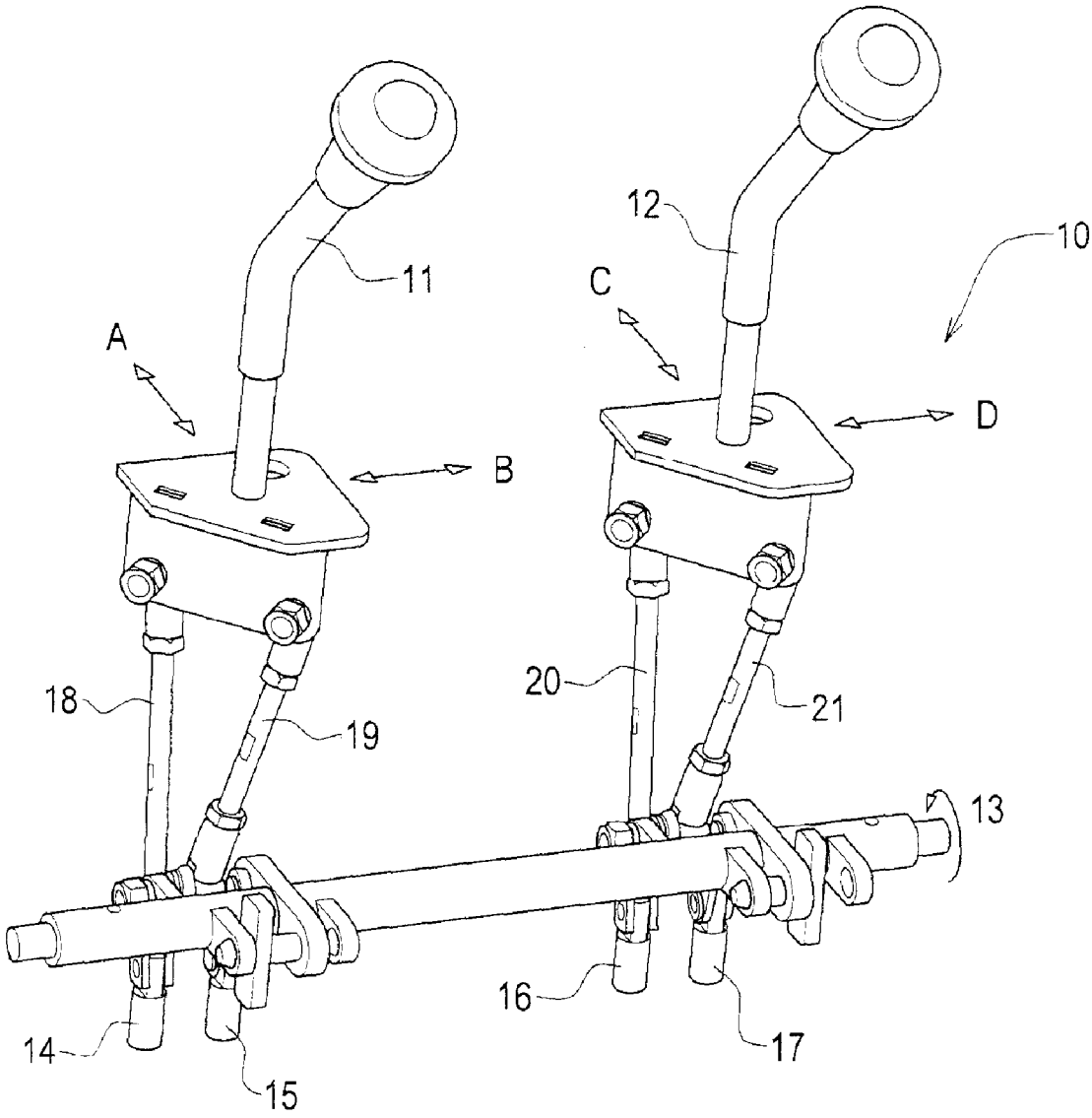
FIG. 2 is a perspective view of a vehicle control apparatus embodying the present invention.

Referring now to FIG. 2 the control apparatus 10 provided with a left operator control lever 11 and a right operator control lever 12. The control levers 11, 12 are connectable through a mechanical link mechanism generally indicated at 13 to hydraulic valve connections shown at 14, 15, 16, 17. The first control lever 11 is moveable backwards and forwards in a direction generally shown at A and side to side in a direction generally shown at B while the control lever 12 is moveable forwards and backwards in a direction generally shown at C and side to side in a direction generally shown at B. The mechanical mechanism 13 is operable to connect the control levers 11, 12 to valve connections 14, 15, 16, 17, such that movement of the control levers in the respective directions A, B, C, D will cause the operation of a hydraulic valve through the appropriate valve connection 14, 15, 16, 17 and hence the operation of a function of the material handling vehicle in the present example to supply hydraulic fluid to hydraulic rams 109, 110, 111 and to control slewing of the body 100 relative to the chassis 102. The first control lever 11 is connected to the mechanism 13 through a first link arm 18 to transmit movement in the direction A and a second link arm 19 to transmit movement in the direction B. The second control lever 12 similarly has a third link arm 20 to transmit movement of the control lever 12 in a direction C and a fourth link arm 21 to transmit movement of the second control lever 12 in the direction D.

Figure 3:
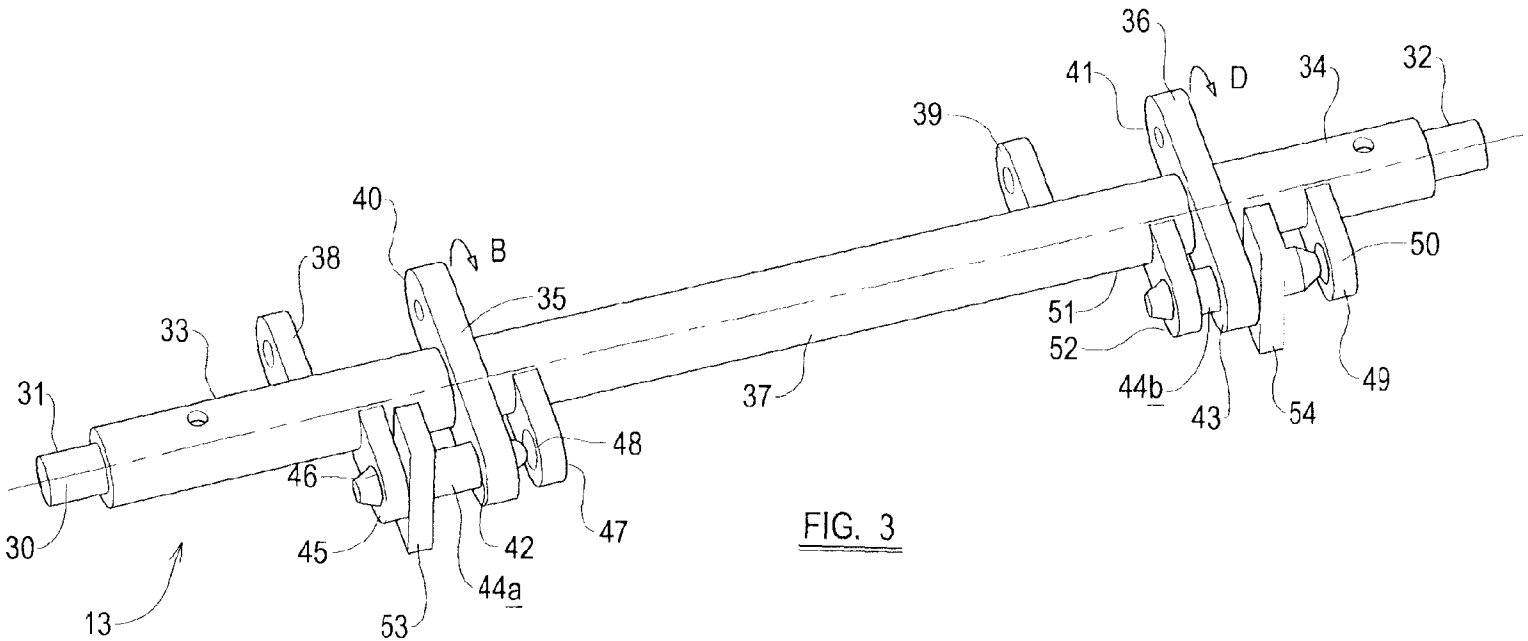
FIG. 3 is a perspective view on a larger scale of part of the control apparatus of FIG. 2.
Figure 4:
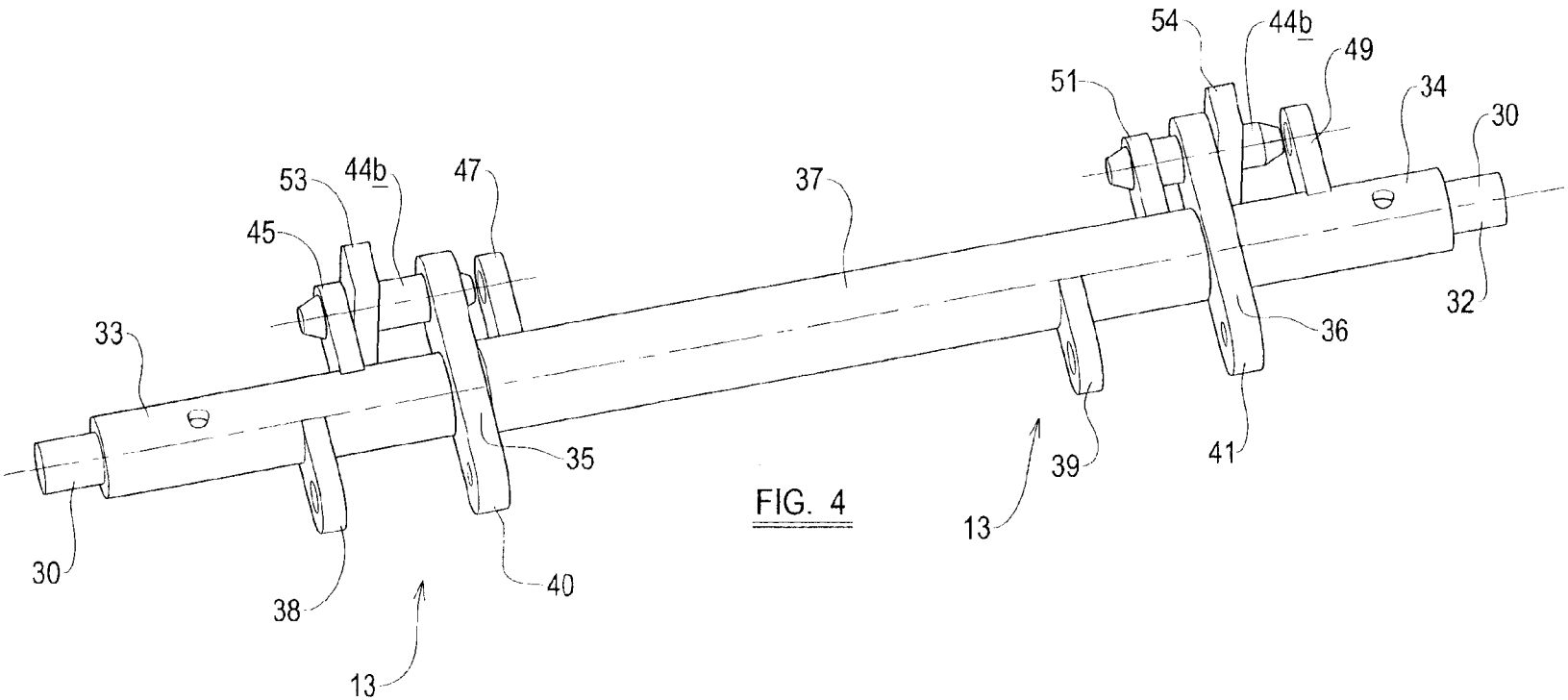
FIG. 4 is a perspective view of the part of FIG. 3, from a different angle.

The mechanical link mechanism 13 will now be described with reference to FIGS. 2 and 3.

The link mechanism 13 comprises a support rod 30, the support rod 30 having end parts 31, 32 which may be rotatable mounted in a suitable support (not shown) first sleeve 33 is mounted on the support rod 30 adjacent the end part 31 and is fixed to the support rod 30 for rotation therewith. A second sleeve 34 is mounted on the support rod 30 adjacent the end 32 and is similarly fixed to the support rod 30 for rotation therewith. Located adjacent the first sleeve 33 is a first pivot arm 35 supported by and rotatable relative to the support rod 30 and adjacent the second sleeve 34 is a second pivot arm 36 supported by and rotatable relative to the support rod 30. Disposed between the first pivot arm 35 and the second pivot arm 36 is a third sleeve 37 supported by and rotatably moveable relative to the support rod 30.

The first sleeve 33 is provided with an ear 38 which is connectable to the second link arm 19 of the first control lever 11 such that movement of the first control lever 11 in the direction A causes movement of the link arm 19 and rotational movement of the first sleeve 33. The third sleeve 37 similarly has an ear 39 for connection to the fourth link arm 21 to cause rotational movement of the second sleeve 37 in response to movement of the second control lever 12. The first pivot arm 35 is connected at a first end 40 to valve connection 15 and the second pivot arm 36 is connected at a first end 41 to valve connection 17.

To provide for connection between the pivot arms 35, 36 and the appropriate ear 38, 39, each pivot arm 35, 36 has at an opposite end part thereof an aperture 42, 43 respectively in which a connecting pin 44*a*, 44*b* is slidably received. The sleeve 33 has a connection arm 45 having an aperture 46 in which the pin 44*a* may be received, and the third sleeve 37 has a first arm 47 having an aperture 48 in which the pin 44*a* may also be slidably received. Similarly, the second sleeve 34 has a connecting arm 49 provided with an aperture 50 in which the pin 44*b* may be slidably received, and the third sleeve 37 has a second connection arm 51 having an aperture 52 in which the connecting pin 44*b* may be slidably received. Each pin 44*a*, 44*b* is fixed to an engagement part 53, 54 respectively which is trapped between the first pivot arm 35 and connection arm 45 and the second pivot arm 36 and connection arm 49 respectively to retain the corresponding pin 44*a*, 44*b* within the mechanism and to allow the pins 44*a*, 44*b* to be moved by an appropriate adjustment mechanism.

When the pins 44*a*, 44*b* are in a first, leftmost position as shown in FIG. 2, movement of the first controller 11 in the direction A will cause movement of the second link arm 19 and hence on the ear 38 to cause rotation of the sleeve 33 and support arm 30. Movement of the first sleeve 33 will cause movement of the connection arm 45, and through the engagement of the pin 44*a* with the connection arm 45 and first pivot arm 35, cause movement of the valve connection 15 and thus operation of the corresponding hydraulic valve. Similarly, movement of the second control lever 12 in the direction C will cause movement of the ear 39 and rotation of the third sleeve 37 relative to the support arm 30, causing movement of the connecting arm 51 and, through the connection of the pin 44*b* rotational movement of the second pivot arm 36 and hence movement of the valve connection 17 and operation of the corresponding hydraulic system.

When it is desired to change the control configuration, the pins 44*a*, 44*b* may be moved in a rightwards direction, such that pin 44*a* is moved out of engagement with connection arm 45 and in to engagement with first connection arm 47, whilst pin 44*b* is moved out of engagement with connection arm 51 and into engagement with connection arm 49. In this configuration, movement of the first control lever 11 in the direction A will cause movement of the second link arm 19 and consequently rotation of the first sleeve 33. Because the first sleeve 33 is fixedly mounted to the support arm 30, this will cause rotation of the second sleeve 34 and consequently movement of the connection arm 49. Through the connection of the pin 44*b*, this will cause rotation of the second pivot arm 36 and hence operation of the valve connection 17 causing operation of a corresponding hydraulic system. Similarly, movement of the second control lever 12 will cause movement of the link arm 21 and hence rotation of the third sleeve 37. Through the engagement of link pin 44*a* with the first connection arm 47, rotation of the third sleeve relative to the support arm 30 will cause rotation of the first pivot arm 35 and consequent movement of the valve connection 15.

Figure 5:
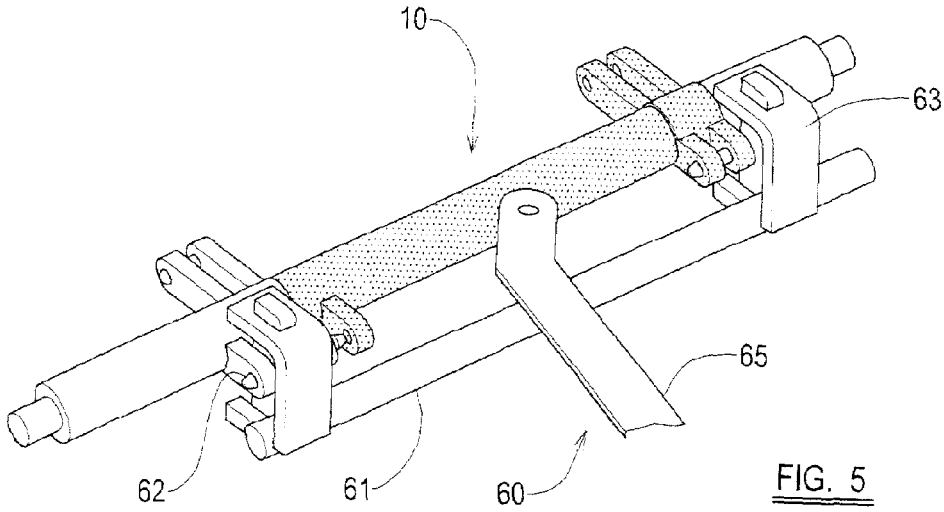
FIG. 5 is a perspective view of the control apparatus of FIG. 2 provided with an actuation mechanism in a first position.
Figure 6:
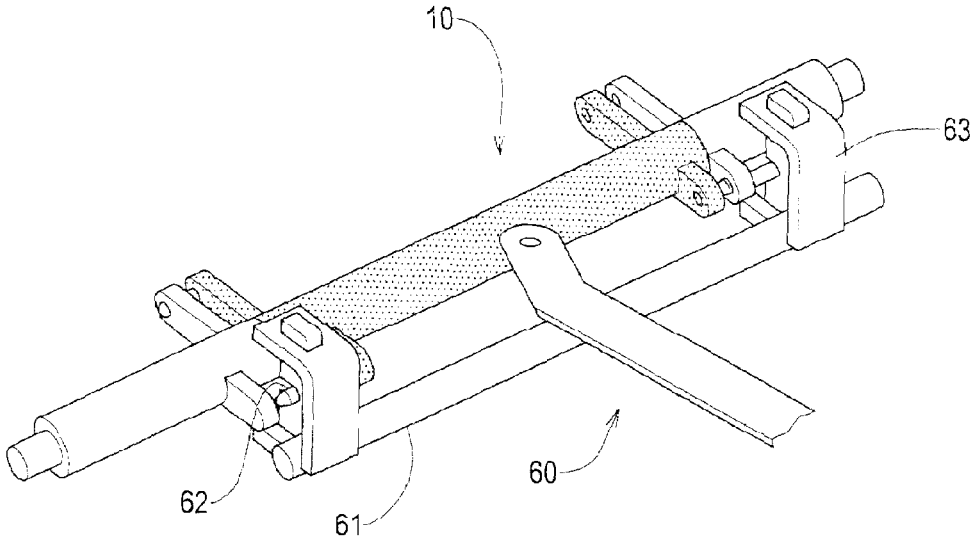
FIG. 6 is a perspective view similar to FIG. 4 with the activation mechanism in a second position.

As shown in FIGS. 5 and 6, the activation mechanism 60 may comprise a simple bar 61 with a first connector 62 to engage the connection part 53 and a second connector 63 to engage the connection part 54. An engagement part 65 is provided to enable the activation mechanism 60 to be moved between a first position as shown in FIG. 5 and a second position where the link pins are engaged as shown in FIG. 6.

The activation mechanism is preferably located where it cannot be directly adjusted by an operator of the machine, for example under a cowling or engine compartment where it can be factory set and adjusted in a workshop. Alternatively, it might be envisaged that the device may be set by an operator of the machine, for example be providing control located in the operators cab.

Figure 7:
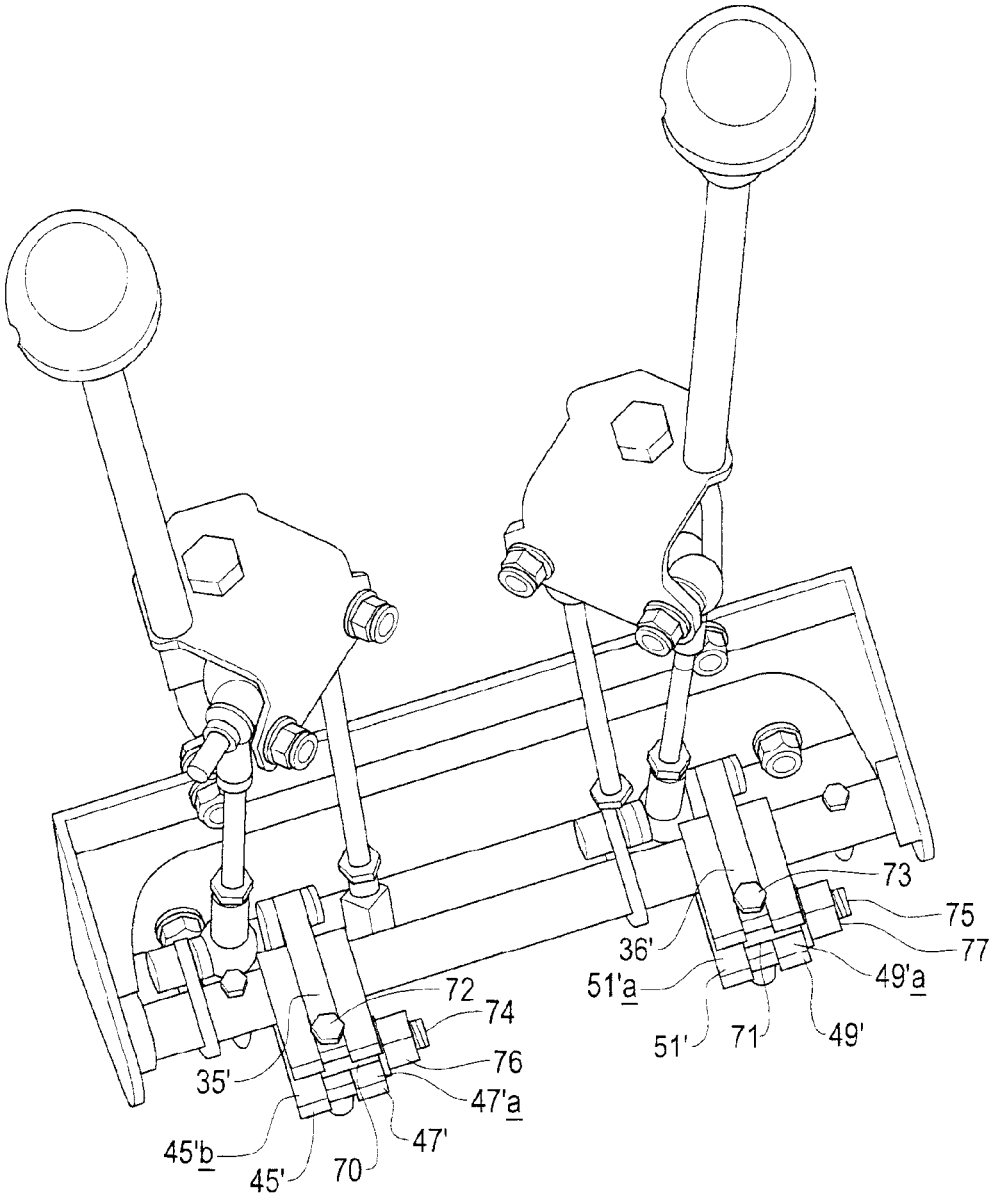
FIG. 7 is a perspective view of an alternate embodiment of the vehicle control apparatus.

Although a particular activation mechanism has been described herein, it will be apparent that any other activation mechanism may be provided as desired. It might even be envisaged that the activation mechanism be omitted and the sliding pins 44*a*, 44*b* be replaced by bolts connecting the pivot arms 35, 36 to the appropriate connection arms 45, 47, 49, 51 depending on the required control configuration. For example, as shown in the alternative embodiment of FIG. 7, pivot arms 35', 36' each have a pivoting bolt 70, 71 respectively pivotally connected at a free end thereof as shown by bolts 72, 73. Connection arms 45', 47' and 49', 51' are located either side of pivot arms 35', 36' respectively. Each of the pivot arms 45', 47', 49', 51' has a slot 45'*a*, 47'*a*, 49'*a*, 51'*a* at the end thereof to receive the respective bolt 70, 71. the bolts 70, 71 have a threaded end part 74, 75 respectively on which a securing bolt 76, 77 is threadably mounted. It will be apparent that to change the control pattern, the locking nut 76, 77 has to be released sufficiently to allow the bolt 70, 71 to be released and rotated out of engagement with one of the slots 45'*a*, 47'*a*, 49'*a*, 51'*a* and rotated into engagement with the opposite one of the slots 45'*a*, 47'*a*, 49'*a*, 51'*a*. The nut 76, 77 is then retightened to lock the control apparatus in place in the alternative control pattern. It will be apparent that any other mechanism for switching control of the apparatus may be provided as desired.

In the present example, the mechanical link mechanism is operable to configure the control such that movement of the control lever 11 direction A operates one of a first function and a second function, movement of the second control lever 12 in direction C operates the other of the first function and the second function. In the specific example, the first function is the operation of the dipper and the second function is the operation of the boom in the first position movement of the control lever in direction A controls the boom 105 and of the second control lever 12 direction C controls the dipper arm 107, the so called ISO position, and operation of the activation mechanism reverses the boom and dipper operation to provide the so called SAE pattern. It will also be apparent that the first and link arms 18, 20 are connected directly to valve connectors 14, 16, such that movement of the first control lever 11 in direction B and movement of the second control lever 12 in direction D always causes operation of the same function, in the specific example slewing movement of the vehicle and operation of the bucket respectively. However, it will be apparent that the mechanical link mechanism may be used to provide any appropriate control pattern connecting control levers 11, 12 to appropriate valve controls for an hydraulic system of the vehicle of FIG. 1 or indeed of any other material handling vehicle as appropriate.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

The invention claimed is:

1. A control apparatus for a material handling vehicle, the control apparatus having a first operator control and a second operator control, a first actuator to operate a first part of the material handling vehicle and a second actuator to operate a second part of the material handling vehicle, a mechanical link mechanism to change the control configuration of the operator controls, the mechanical link mechanism comprising a mechanical link moveable between a first position to connect the first operator control to the first actuator and the second operator control to the second actuator, and a second position to connect the first operator control to the second actuator and the second operator control to the first actuator, the mechanical link mechanism comprising:

a support arm, a first arm supported by and rotatable relative to the support arm and connected to the first actuator, a second arm supported by and rotatable relative to the support arm and connected to the second actuator, a third arm supported by the support arm and connected to the first operator control, and a fourth arm supported by and rotatable relative to the support arm and connected to the second operator control, the mechanical link comprising:

a first connection element connecting the first arm to one of the third arm and the fourth arm, and a second connection element to connecting the second arm to the other of the third arm and the fourth arm.

2. A control apparatus according to claim 1 wherein the first operator control is further connected to a third actuator and the second operator control is further connected to a fourth actuator.

3. A control apparatus according to claim 1 wherein actuators comprise hydraulic valves operable to control a supply of hydraulic fluid to the elements of the material handling vehicle.

4. A control apparatus according to claim 3 wherein the material handling vehicle comprises a material handling apparatus comprising a boom and a dipper, wherein the first actuator is operable to control operation of the boom and the second actuator is operable to control movement of the dipper.

5. A control apparatus according to claim 4 wherein the first operator control is further connected to a third actuator and the second operator control is further connected to a fourth actuator, wherein the third actuator is operable to control the slewing movement of the arm and the fourth actuator is operable to cause movement of a material handling device mounted on the dipper.

6. A control apparatus according to claim 5 wherein the first operator control comprises a lever and the second operator control comprises a lever.

7. A control apparatus according to claim 1 wherein the material handling vehicle comprises a material handling apparatus comprising a boom and a dipper, wherein the first actuator is operable to control operation of the boom and the second actuator is operable to control movement of the dipper.

8. A control apparatus according to claim 1 wherein the first operator control is further connected to a third actuator and the second operator control is further connected to a fourth actuator, wherein the third actuator is operable to control the slewing movement of the arm and the fourth actuator is operable to cause movement of a material handling device mounted on the dipper.

9. A control apparatus according to claim 1 wherein the first operator control comprises a lever and the second operator control comprises a lever.

* * * * *